United States Patent [19]

Inoue

[11] 4,236,345

[45] Dec. 2, 1980

[54] TOY ASSEMBLY WITH SELECTIVE PROPULSION OF SUBCOMPONENT PARTS

[75] Inventor: Tsutomu Inoue, Ichikawa, Japan

[73] Assignee: Takara Co., Ltd., Tokyo, Japan

[21] Appl. No.: 45,385

[22] Filed: Jun. 4, 1979

[51] Int. Cl.[3] ..... A63H 29/16

[52] U.S. Cl. ..... 46/44; 46/202

[58] Field of Search ..... 46/44, 74 B, 74 A, 74 R, 46/202, 145

[56] References Cited

U.S. PATENT DOCUMENTS

| | | | |
|---|---|---|---|
| D. 159,934 | 8/1950 | Sewell | 46/44 X |
| 3,481,069 | 12/1969 | Meyer | 46/44 |
| 3,589,058 | 6/1971 | Labat | 46/44 |
| 4,149,338 | 4/1979 | Wolf | 46/44 |
| 4,167,830 | 9/1979 | Ogawa | 46/202 X |

*Primary Examiner*—Robert Peshock
*Assistant Examiner*—Mickey Yu
*Attorney, Agent, or Firm*—Jackson, Jones & Price

[57] ABSTRACT

The present invention is directed to a mobile toy assembly capable of ejecting toy subcomponents by air pressure. Preferably the mobile toy assembly has a simulated configuration of a rocket ship with an upper portion being simulated as a fuselage while also being the external surface of a plunger that forms part of a bellows assembly for generating air pressure. The nose section of the rocket ship can be bigurcated to permit the propulsion of a small vehicle member while rocket pods on each of the side wings can support toy rocket projectiles. A control knob on the surface of the fuselage can selectively direct the air pressure to a particular toy subcomponent to be propelled.

16 Claims, 6 Drawing Figures

FIG. 5
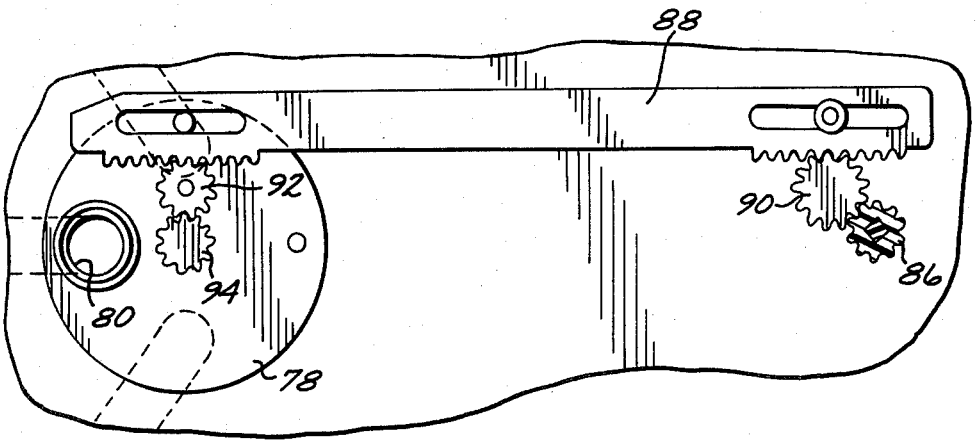
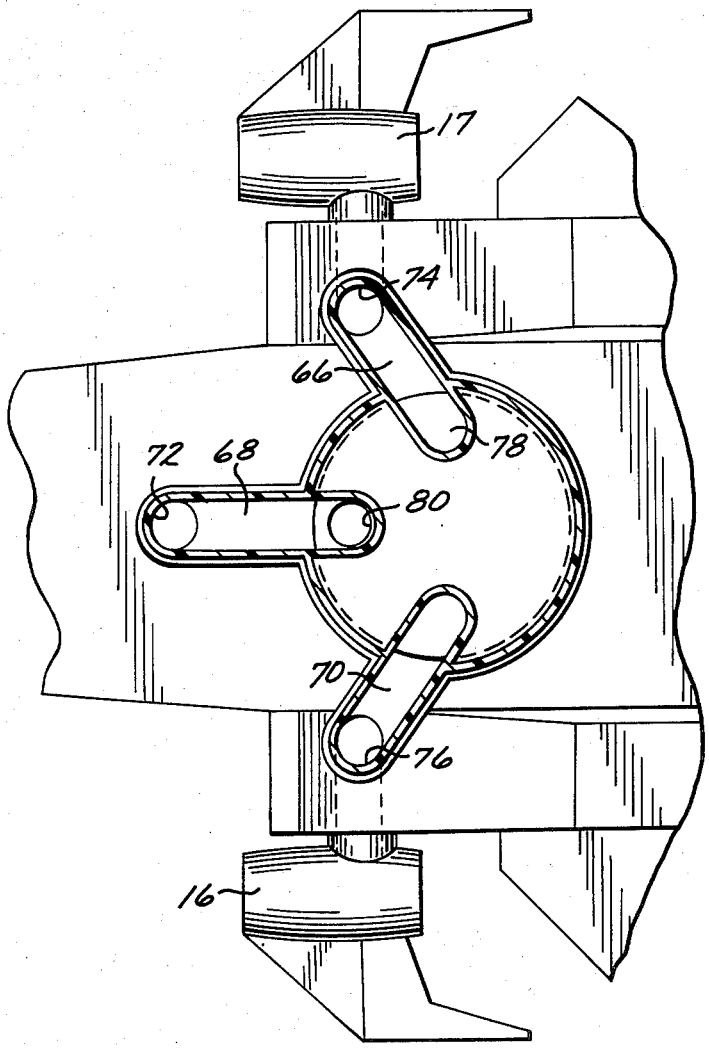
FIG. 6

TOY ASSEMBLY WITH SELECTIVE PROPULSION OF SUBCOMPONENT PARTS

BACKGROUND OF THE INVENTION

1. Field of the Invention

The present invention is directed to the toy industry and more particularly to a mobile toy assembly that incorporates a unique air pressure system for propelling projectiles and small vehicles away from the body of the toy assembly.

2. Description of the Prior Art

The toy industry has provided a large number of various designed mobile toys for use by children. These vehicle toys are generally limited to relatively few play options for the child. Since the child's span of attention is somewhat limited, the enjoyment value of a toy will increase in direct proportion to the variation in action modes that are capable of being exercised. The toy industry has been aware of various tubed track systems wherein a motor or fan generates air pressure for driving a vehicle through the tube system.

As can be readily appreciated, the toy industry is always striving to increase the novelty and play options available to a child such as that provided by the present invention.

SUMMARY OF THE INVENTION

The present invention provides a toy assembly for propelling at least one secondary toy component such as a miniature vehicle. The toy assembly includes a body member capable of mounting a plurality of secondary toy components. For example, the body member can take the form of a jet plane or rocket ship with rocket mounting pods positioned on either side of a fuselage adjacent simulated wings. The nose cone can be bifurcated and of such a dimension to house a small vehicle member. The bifurcated forward section of the nose cone is capable of opening to provide access for insertion and removal of the small vehicle member. Means are provided for generating an air pressure such as a bellows assembly mounted in the fuselage section of the body member. Air passageways or conduit means are provided throughout the body member to interconnect with the rear of the nose cone section and the base of the rocket pods and also to interconnect with the bellows assembly. A switch assembly is capable of selectively directing the air pressure generated by the bellows to at least one of the toy component members whereby the air pressure can discharge the toy component member such as the vehicle from the body member.

While various configurations of the body member are possible, the preferred embodiment is in the form of a rocket ship with the bellows assembly having an exterior lid designed to simulate a control deck or cockpit of the rocket ship. A pair of parallel wings on either side of the rocket ship fuselage are relatively movable for securing the vehicle member in one play option.

The objects and features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 5 is a plan view taken along the line 5—5 of FIG. 4, and

FIG. 6 is a bottom view taken along the line 6—6 of FIG. 4.

DESCRIPTION OF THE PREFERRED EMBODIMENT

The following description is provided to enable any person skilled in the toy industry to make and use the invention and sets forth the best mode contemplated by the inventor of carrying out his invention. Various modifications, however, will remain readily apparent to those skilled in the toy industry, since the generic principles of the present invention have been defined herein specifically to provide a relatively economical and easily manufactured mobile toy assembly capable of projecting a plurality of projectiles.

Figure 1:
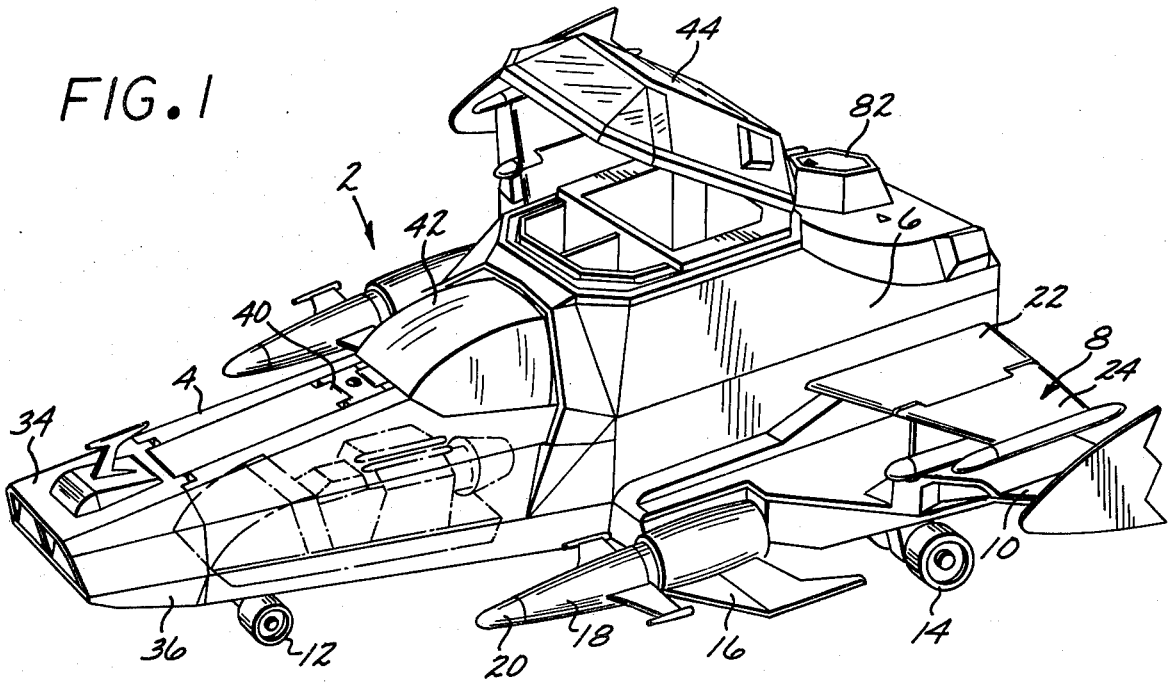
FIG. 1 is a perspective view of the rocket ship of the present invention.

Referring to FIG. 1, a perspective view of a mobile toy assembly 2 having a simulated rocket ship configuration is disclosed.

The rocket ship 2 includes a nose section 4 connected to a fuselage 6. A pair of parallel wings 8 and 10 are mounted on each side of the fuselage 6. A nose wheel assembly 12 supports the nose section 4 and includes a pair of wheels. Likewise, a wing wheel assembly 14 having a pair of wheels is provided on the lower wing 10. Another wing wheel assembly (not shown) is mounted on the other side to permit mobility of the vehicle as it translates across a support surface.

As can be readily appreciated, each of the component parts of the present toy can be formed from plastic although the principles of the present invention can be accomplished with other material.

Mounted on each side of the fuselage 6 adjacent the front section of the respective lower wings are rocket projectile mounting pods such as pod 16. A rocket projectile 18 having a soft rubber nose 20 is removably mounted within the mounting pod 16. The mounting pod 16 is pivotally attached to the lower wing 10 so that a child can direct its angular disposition relative to the fuselage. As will be discussed subsequently, the rocket projectile 18 can thereby be lobbed or shot in a flat trajectory depending upon the desire of the child.

Figure 3:
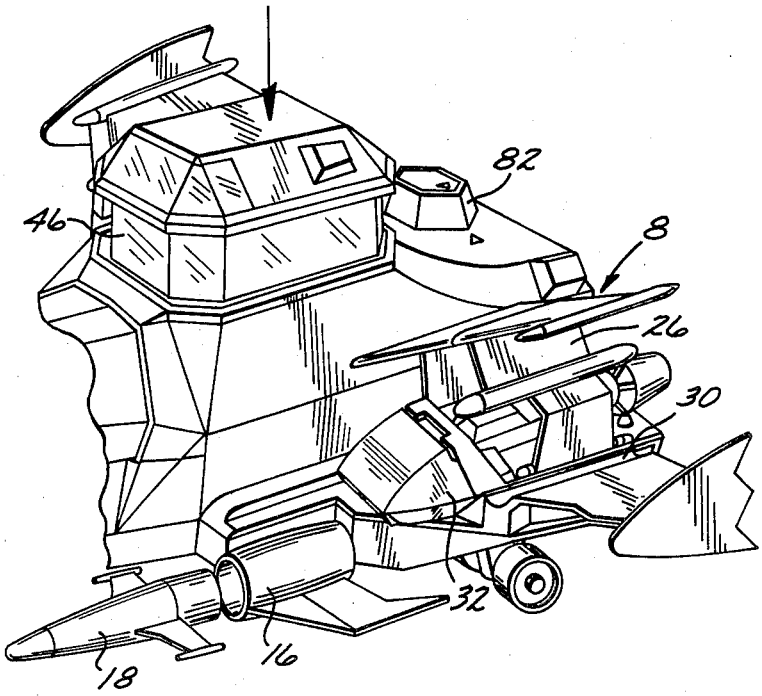
FIG. 3 is a partial perspective view disclosing the projection of a toy rocket projectile member.

The upper wing on each side of the fuselage 6 is pivotally mounted to the fuselage body 6 as can be seen in FIG. 3. Additionally, the upper wing is further bifurcated into two parts, 22 and 24 that are pivotally mounted relative to each other. A strut member 26 supports a simulated rocket member 28 that can be conveniently seated within a groove 30 in the lower wing 10. The space between the upper wing 8 and the lower wing 10 conveniently forms a cavity for receiving and securing a small vehicle member 32. The relative movement of the upper wing 8 assists in positioning the small vehicle.

The small vehicle member 32 is provided with a plurality of rotatable wheels (not shown) mounted on its lower base and can also include a transparent canopy that can be pivotally opened to provide access to the interior of the small vehicle. Conveniently, this internal storage space can receive a miniature operator doll in a horizontal position (not shown). This storage feature heightens the realism of play action for the child.

Figure 2:
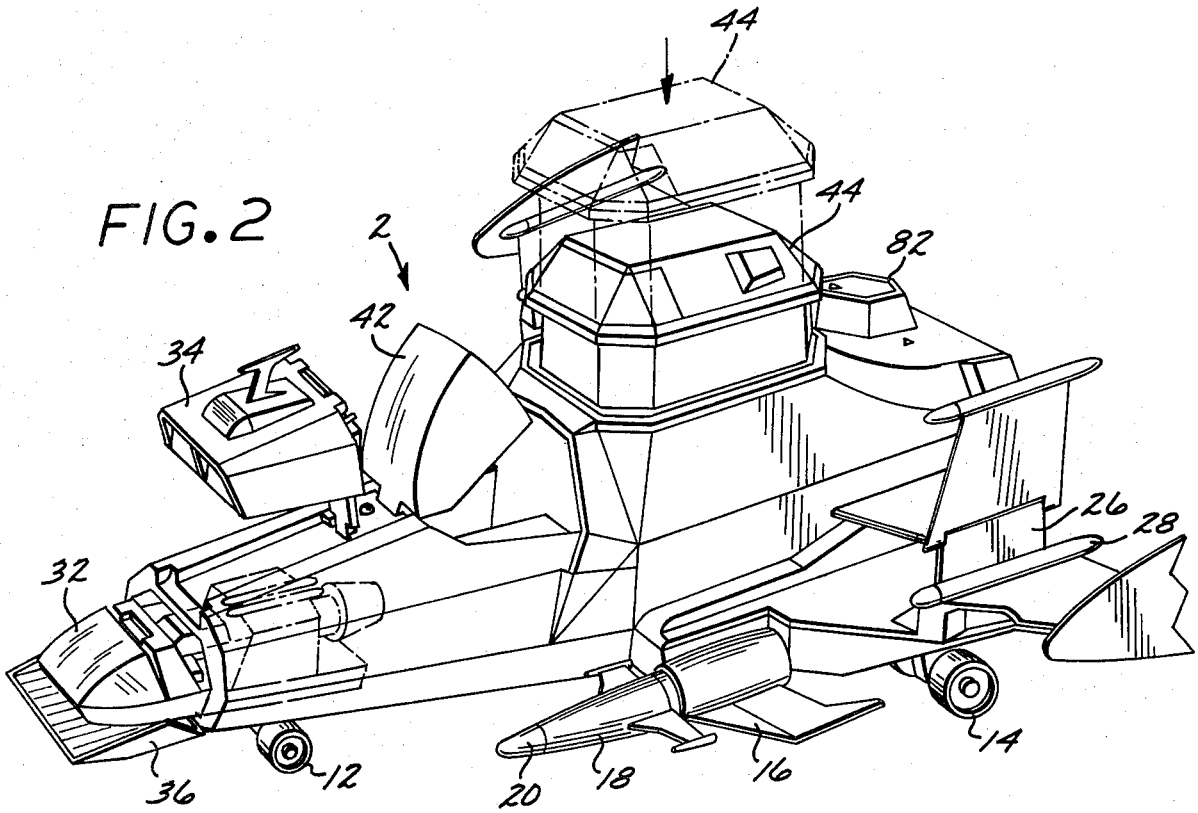
FIG. 2 is a perspective view disclosing the relative movement of varous component parts of the present invention.

The nose section 4, is bifurcated into an upper cover member 34 and a lower ramp member 36. The lower ramp member 36 is pivotally attached to the nose section and has a dimensioned size that permits it to provide a support surface from ground level to the interior floor of the nose section 4. The upper cover member 34 is pivotally mounted at one end of a lever member 38. The lever member 38 in turn is pivotally mounted by a joint assembly 40 to the nose section 4. As can be seen in FIG. 2, the upper cover member 34 can be subjectively positioned such as above and relatively parallel to its previously closed position as a portion of the nose section 4. A transparent canopy 42 can also be pivotally mounted to the nose section 4 to permit access to a cavity for again receiving a toy operator doll.

The central section of the rocket ship 2 or fuselage 6 supports a bellows assembly that is capable of manually generating a source of air pressure. A pivotally mounted lid 44 is externally configured to simulate a canopy of control deck for the rocket ship 2. A relatively rectangular plunger 46 which can be seen in a cross-sectional view in FIG. 4 includes a lower rim or lip 48 which cooperates with a peripheral flange 50 on the upper portion of a plenum chamber 62 to provide a limit or stop to the upward vertical travel of the bellows plunger member 46. A spring 52 biases the bellows plunger member 46 towards a vertically extended position. As can be appreciated other forms of bellow assemblies can be used such as a flexible diaphragm.

To further simulate play action, an internal sleeve member 54 is mounted within the cavity of the hollow plunger 46 to provide separate compartments for both storage of small toy items and positioning of toy doll figures that can appear to be controlling the operation of the toy rocket ship 2 by viewing the direction of the rocket ship through the forward translucent portion of the lid 44.

A pivotal latch member 56 is capable of securing a keeper bar 58 that also pivotally mounts the lid 44. A cam member 60 extends from the lid 44 and is capable of forcing the latch member 56 away from the keeper bar 58 when the lid 44 is rotated to an open position. Additionally, the upper surface of the latch member 56 is also designed for manual manipulation by a child to manually release the plunger member 46 from its retracted position as shown in FIG. 1. When the plunger member 46 is in a retracted position, the exterior configuration of the lid 44 compliments the simulated appearance of a rocketship and effectively conceals the bellows plunger member 46.

Figure 4:
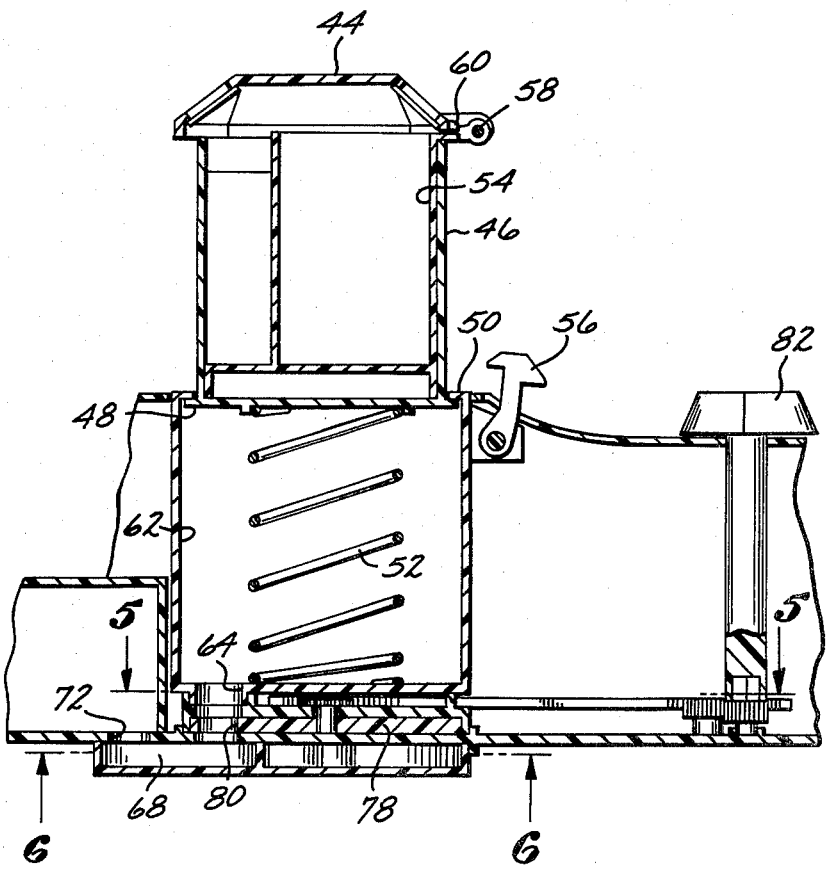
FIG. 4 is a cross-sectional view of the bellows assembly and fuselage of the present invention.

Referring to FIGS. 4, 5 and 6, the operation of a switch assembly for selectively directing the air pressure to the various toy component members that are to be projected from the rocket ship is disclosed. The plenum chamber or cylinder 62 mounts the bellows plunger member 46 and is connected through a bottom part or aperture 64 to a plurality of conduits 66, 68 and 70. Each one of these respective conduits provide access to a rear mounting of the toy components such as the rocket projectiles 18 and the small vehicle member 32 that are to be discharged by air pressure from the rocket ship 2.

As can be seen in FIG. 4, an aperture 72 provides access via conduit 68 to the air pressure from the bellows assembly for the vehicle member 32. Likewise, apertures 74 and 76 provide access to respectively the rocket mounting pods 17 and 16. A rotatable disk 78 having a single aperture 80 controls the egress of air from the plenum chamber 62 when the plunger member 46 is manually depressed. The rate at which the plunger member 46 is depressed with determine the volumetric flow of air and the corresponding force that is exerted upon the toy components.

A manual control member or knob 82 with an appropriate indicia indicator is rotatively mounted on the exterior of the rear portion of the body member of the rocket ship 2. By appropriately aligning this knob 82 with indicators mounted at the nine o'clock, twelve o'clock and three o'clock positions, the child can determine the selective direction of the air flow to a specific toy component member. Referring to FIG. 3, the knob member 82 has been positioned to direct air to the mounting pod 16 whereby the air pressure will discharge the rocket projectile 18 as the plunger member 46 is forced downward.

As can be seen from FIGS. 4 and 5, the knob member 82 is attached to a shaft 84 which terminates in a gear 86. The gear 86 forms part of a gear transmission assembly that interfaces with a movable pawl member 88. An idler gear 90 is juxtapositioned between the gear 86 on the shaft 84 and the teeth of the pawl member 88. Appropriate slots and alignment pins limit the travel of the pawl member 88. At the other end of the pawl member 88, appropriate teeth again interface with a rotatively mounted idler gear 92 that in turn contacts a gear member 94 projecting from the rotatable disk 78. Accordingly, rotation of the manual control knob 82 is translated into linear movement of the pawl member 88 which in turn rotates the air control disk 78.

In operation, a child operator can preselect a position to the manual control knob 82 such as to discharge the rocket projectile 18. The child can then either pivotally open the lid 44 which will permit cam 60 to provide a clockwise rotational movement to the latch member 56 to release the bellows plunger member 46, or he can manually rotate the latch member to release the keeper bar 58. The spring 52 will automatically extend the plunger member 46 to its furthest position from the fuselage 6. As can be seen from FIG. 3, the child will then depress the plunger member 46 with a downward vertical movement and the rate of dissent will control the air pressure capable of propelling the rocket projectile 18.

The construction of the plenum chamber 62 and its interface with the plunger member 46 are such that excessive air pressure cannot be generated to avoid any possibility of harm to a child. The child has the option of discharging in a similar fashion both the other rocket projectile from the mount pad 17 and the small vehicle 32 from the nose section 4. Prior to ejecting the small vehicle 32, the child will relatively pivot both the cover member 34 and the ramp member 36, that together forms the end of the nose section 4 of the rocket ship 2, to an open position. With the nose section 4 bifurcated, the small vehicle member 32 is then capable of being ejected from the nose section. As can be appreciated, the interior dimensions of the nose section 4 approximate the side peripheral configuration of the small vehicle member 32 to permit sufficient air pressure to build up behind the vehicle member 32 for propulsion of the small vehicle member. Once the small vehicle member 32 has been ejected, it is subsequently capable of storage between the pair of wing members 8 and 10 by the relative rotation of the upper wing member 8.

While the above description discloses the preferred embodiment of the invention, it is readily apparent that the generic principles of the present invention are applicable in other embodiments and accordingly, the present invention should not be limited in scope and should be determined solely from the following claims.

What is claimed is:

1. A mobile toy assembly comprising;

a small vehicle member;

a body member configured to simulate a rocket ship and having a nose section of such a dimension to house the small vehicle member and capable of opening to provide an access for insertion and removal of the small vehicle member;

at least one projectile member removably attached to the body member;

means for generating an air pressure;

conduit means connected to at least the nose section and the projectile member, and means for selectively directing the air pressure to one of the projectile members and the small vehicle positioned in the nose section to propel the same away from the body member.

2. The invention of claim 1 wherein the means for generating an air pressure includes a movable bellows.

3. The invention of claim 1 wherein a second projectile member is removably attached to the body member and the conduit means further is connected to the second projectile member and the selective means can also direct air pressure to the second projectile member for propelling the same away from the body member.

4. The invention of claim 1 wherein the means for selectively directing air includes a manual control member mounted on the exterior of the body member and a valve member rotatively mounted within the conduit means and operatively connected to the control member.

5. The invention of claim 4 further including a movable pawl member and a gear transmission means for transmitting the movement of the control member to the valve.

6. The invention of claim 1 further including at least a pair of simulated wing members mounted in parallel on the body member, one wing member pivotally mounted and configured to retain the small vehicle member when placed between the wing members.

7. The invention of claim 1 wherein the means for generating an air pressure includes a bellows member mounted on the body member, the bellows member further having a storage compartment with a movable lid mounted on one side, the exterior of the lid simulating a cockpit.

8. The invention of claim 7 wherein the bellows member is spring mounted and is biased to an extended position and means for retaining the bellows member in a depressed position so that the body member maintains the simulted configuration of a rocket ship.

9. The invention of claim 8 wherein a pivotal latch member is capable of retaining the bellows member in a depressed position and the lid further contains a cam member capable of releasing the bellows member when the lid is opened a predetermined distance.

10. The invention of claim 1 wherein the nose section is bifurcated to provide an upper cover member pivotally mounted to the body member and a lower ramp member pivotally mounted to the body member.

11. The invention of claim 10 further including a lever member pivotally mounted on the body member at one end and supporting the upper cover member at the other end.

12. The invention of claim 1 further including means attached to the body member for translational movement across a support surface.

13. A toy assembly for propelling secondary toy components comprising;

a body member;

a plurality of secondary toy components;

mounting means for detachably retaining the toy component members to the body member;

means for generating an air pressure includes a bellows member mounted on the body member, the bellows member further having a storage compartment with a movable lid mounted on one side, the exterior of the lid simulating a cockpit, and conduit means connected to the means for generating an air pressure and to each of the removably mounted toy component members including a switch assembly for selectively directing the air pressure to at least one of the toy component members whereby the air pressure can discharge the toy component member from the body member.

14. The invention of claim 13 wherein the switch assembly for selectively directing air includes a manual control member mounted on the exterior of the body member and a valve member rotatively mounted within the conduit means and operatively connected to the control member.

15. The invention of claim 14 further including a movable pawl member and a gear transmission means for transmitting the movement of the control member to the valve.

16. The invention of claim 13 wherein the bellows member is spring mounted and is biased to an extended position and means for retaining the bellows member in a depressed position so that the body member maintains the simulated configuration of a rocket ship.

* * * * *